US006475307B1

(12) United States Patent
Nyström et al.

(10) Patent No.: US 6,475,307 B1
(45) Date of Patent: Nov. 5, 2002

(54) METHOD FOR FABRICATING VEHICLE COMPONENTS AND NEW USE OF A PRECIPITATION HARDENABLE MARTENSITIC STAINLESS STEEL

(75) Inventors: Anna-Lena Nyström, Sandviken (SE); Anna Hultin Stigenberg, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/713,021

(22) Filed: Nov. 16, 2000

(51) Int. Cl.[7] ..... C21D 8/10; C22C 38/44; C22C 38/50; C22C 38/40

(52) U.S. Cl. ..... 148/326; 148/325; 148/547; 148/608; 148/610; 148/592; 148/593; 148/590; 148/327

(58) Field of Search ..... 148/325, 326, 148/547, 608, 610, 592, 593, 590

(56) References Cited

U.S. PATENT DOCUMENTS 5,494,537 A * 2/1996 Miyakusu et al. ..... 148/325
5,632,826 A 5/1997 Hultin-Stigenberg et al.

OTHER PUBLICATIONS

M. Holmquist et al., "Isothermal Formation of Martensite in a 12Cr–9Ni–4Mo Maraging Stainless Steel," *Scripta Metallurgica et Materialia*, vol. 33, No. 9, 1995, pp. 1367–1373.
J.–O. Nilsson et al., "Isothermal Formation of Quasicrystalline Precipitates and Their Effect on Strength in a 12Cr–9Ni–4Mo Maraging Stainless Steel," *Metallurgical and Materials Transactions A*, vol. 25A, Oct. 1994, pp. 2225–2233.

* cited by examiner

*Primary Examiner*—Deborah Yee
(74) *Attorney, Agent, or Firm*—Burns, Doane, Swecker & Mathis, LLP

(57) ABSTRACT

A composition and method for the manufacture of products of a precipitation hardenable martensitic stainless steel, the composition of which comprises at least 0.5% by weight of Cr and at least 0.5% by weight of Mo wherein the sum of Cr, Ni and Fe exceeds 50%. The method steps include smelting the material into a casting, hot extrusion followed by a number of cold deforming steps so as to obtain at least 50% martensite and finally an ageing treatment at 425–525° C. to obtain precipitation of quasicrystalline particles. Such material can be used in vehicle components where demands for corrosion resistance, high strength and good toughness are to be satisfied.

11 Claims, 1 Drawing Sheet

Figure 1:
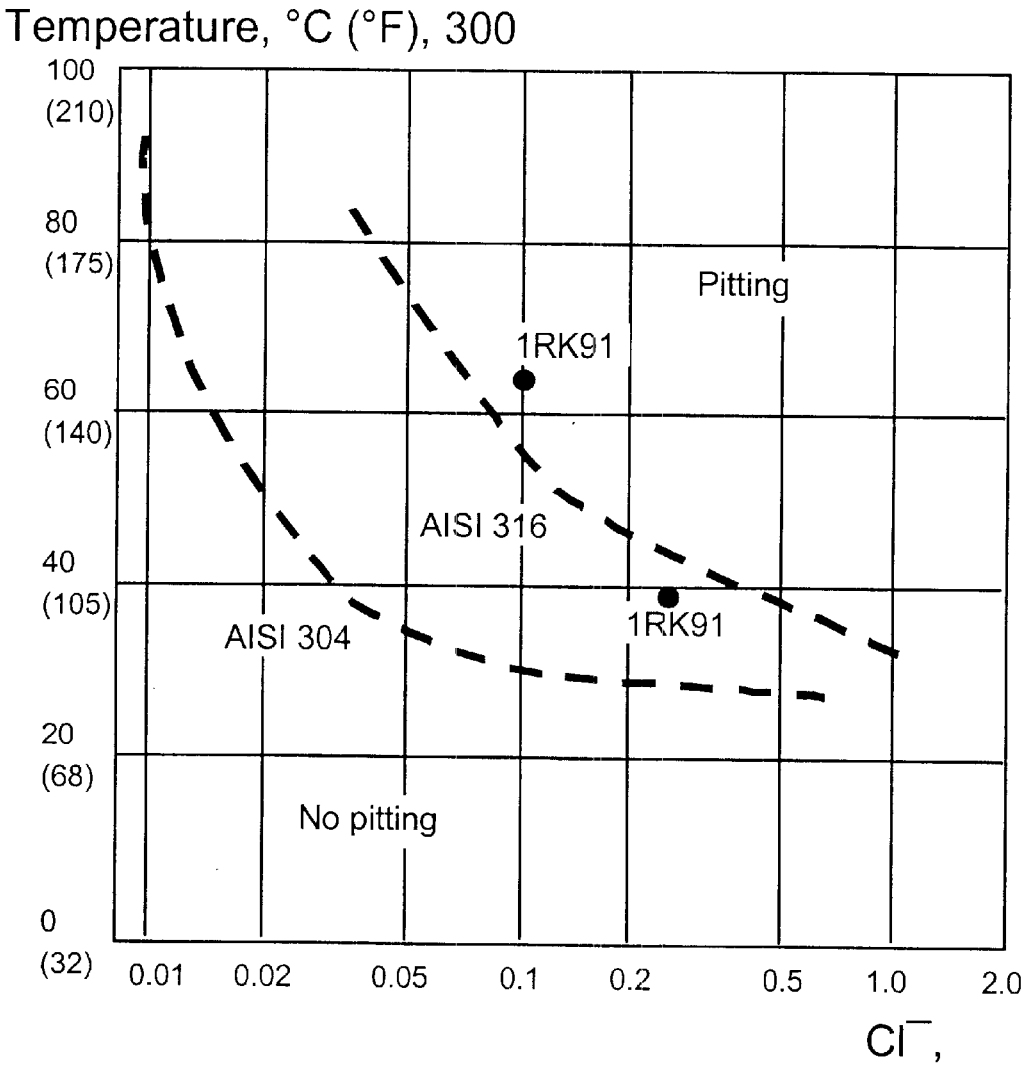

METHOD FOR FABRICATING VEHICLE COMPONENTS AND NEW USE OF A PRECIPITATION HARDENABLE MARTENSITIC STAINLESS STEEL

FIELD OF THE INVENTION

The present invention elates to precipitation hardenable martensitic stainless steel, hereafter called stainless maraging steel. More particularly, the present invention relates to a maraging steel for certain applications, such as in the vehicle industry (cars, trucks, motorcycles for example), where several benefits regarding product properties and manufacturing processes have been obtained.

BACKGROUND

Normally, carbon steel tubes are used for shock absorbers in cars. These tubes are hardened and surface treated in different ways depending on type of product. The manufacturing process involves many steps and tempering operations, which could cause rejections since the demands regarding dimensional tolerances of such tubes are very high.

It has to be noted that the combination of martensite transformation and precipitation hardening on its If is known from the document Metall. Mater. Trans. A., 25A, 2225–2233, 1994. This document discloses the precipitation in the martensitic structure of intermetallic compounds of quasicrystalline structure based on iron, molybdenum, chromium and silicon. The martensite in said alloy can be formed both by deformation, as described in he document above, or isothermally as described in Scripta Metallurgica et Materialia, 995, Vol.33, No. 9, pp. 1367–1373. This new type of steel alloys was found to exhibit a combination of superior strength, corrosion resistance and ductility. In fact, a tensile strength in the interval 2500–3000 MPa was attained for wire products in the cold worked and aged condition which makes such material well suited for medical and dental instruments. This document does not, however disclose a method of manufacture which allows t form steel products of a desired shape by deformation whilst achieving an optimum between ductility, strength, formability and corrosion resistance and homogeneity of martensite distribution.

SUMMARY OF THE INVENTION

The steel alloy treated according to the present invention can be processed in the shape of wire, tube, bar and strip for further use in various vehicle and automotive components. It is an object of the invention to provide a very efficient method for the manufacture of easily formable steel products with a homogeneous distribution of martensite and precipitates making them suitable for usage in components in the vehicle or automotive industry.

By using the stainless maraging steel according to the present invention, the manufacturing process to obtain the final product can be much shorter. Hardening by precipitation of intermetallic compounds gives the product a very high strength level. It is known that material for the application shock absorbers is subjected to very high demands regarding mechanical properties.

In contrast to conventional high strength steels, maraging steels possess certain distinctive characteristics such as lack of distortion during hardening, good weldability and a good combination of strength and toughness that have made them attractive for many applications. In comparison to conventional stainless steels, the physical properties of stainless maraging steels are closer to the properties of the carbon steels used today.

According to a first aspect, the present invention provides a component having corrosion resistance, high strength and toughness, made from a stainless maraging steel material having a composition comprising: at least 0.5% by weight chromium, at least 0.5% by weight molybdenum, the sum of Cr, Ni and Fe exceeds 50% by weight, and the steel has a microstructure including intermetallic particles precipitated into a matrix of martensite.

According to a further aspect, the present invention provides a method of manufacturing a steel alloy component comprising: smelting an alloy having a composition comprising at least 0.5% by weight chromium, at least 0.5% by weight molybdenum, and the sum of Cr, Ni and Fe exceeds 50% by weight; casting the alloy; subjecting the casting to hot extrusion and then to a plurality of cold deforming steps to obtain of at least 50% martensite throughout its microstructure; and subjecting the alloy to an ageing treatment at 425–525° C. that is sufficient to obtain precipitation of quasicrystalline particles in the martensitic microstrucure.

BRIEF DESCRIPTION OF THE DRAWING FIGURE

FIG. 1 shows Critical Pitting Temperature (CPT) for 1RK91, AISI 304 and AISI 316 at varying concentrations of sodium chloride using Electrochemical CPT testing with potentiostatic determination at +300 mVSCE, pH=0.6, ground test samples (600 m). All results are average results from six measurements.

DETAILED DESCRIPTION OF THE INVENTION

In accordance with the present invention a martensitic stainless steel alloy, more specifically a precipitation hardenable stainless steel alloy containing at least 0.5% Cr and 0.5% Mo with properly optimized constituents, wherein the sum of Cr, Ni and Fe exceed 50%, has been found to be well suitable for use in environments where demands for good resistance to corrosion in combination with high strength and toughness are to be satisfied. One such application is vehicle and automotive components. More specifically, such alloys are fabricated such that the precipitation of intermetallic quasicrystalline particles are obtained in a matrix of martensite.

One embodiment of a steel alloy according to the invention should preferably consist of, in weight-%:

| | |
|---|---|
| Carbon | max 0.1 |
| Nitrogen | max 0.1 |
| Copper | 0.5–4 |
| Chromium | 10–14 |
| Molybdenum | 0.5–6 |
| Nickel | 7–11 |
| Cobalt | 0–9 |
| Tantalum | max 0.1 |
| Niobium | max 0.1 |
| Vanadium | max 0.1 |
| Tungsten | max 0.1 |
| Aluminum | 0.05–0.6 |
| Titanium | 0.4–1.4 |
| Silicon | max 0.7 |
| Manganese | ≦1.0 |

-continued

| | |
|---|---|
| Iron | remainder (except usual impurities, in total max 0.5%) |

More preferably the fabricating of this alloy should be made in such a manner that the precipitation, after deformation to establish deformation martensite, appear as quasicrystalline particles. It has been found that enhanced mechanical properties can be achieved in this special type of alloy if the total amount of deformation can occur without intermediate annealing steps between each and every deformation step.

The fabrication of the material occurs by first smelting the iron based alloy in an arc furnace under protected atmosphere having the above-mentioned compositions. The material is then poured off to produce a casting which is then subjected to hot extrusion after which a hollow tube is obtained, which is then introduced into a pilgering mill while being subjected to cold reduction, after which the material is subjected to further deformation by cold drawing with a degree of reduction such that the total degree of cold reduction is sufficient for obtaining a martensite level of at least 50%, preferably at least 70%. The material is finally subjected to ageing at 425–525° C., preferably at around 475° C., for 4 hours and is then ready for being used in a suitable form for vehicle components or similar application.

As one preferred embodiment it was found that the material having the described composition and processed in the manner set forth above was very well suitable for the making of shock absorbers for automotive vehicles, which are normally produced as tubular components.

The mechanical properties are specifically important for a material which shall be well suited for being used in vehicle components. At the same time, the material should be easily formable so as to enable its fabrication in the form of wire, tube, bar and strip for its further use in these kind of applications.

In order to investigate the mechanical properties of the material according to this invention such material has been subjected to fatigue tests together with other existing alternative conventional carbon steel materials.

The present invention will now be further described by reference to the following examples, which are illustrative rather than restrictive.

An iron based alloy according to the invention was subject of this fatigue testing, having the analysis as given in Table 1.

TABLE 1

Chemical Composition of 1RK91 (wt-%)

| Steel | C + N | Cr | Mn | Fe | Ni | Mo | Ti | Al | Si | Cu |
|---|---|---|---|---|---|---|---|---|---|---|
| Sandvik 1RK91 | <0.05 | 12.0 | 0.3 | bal. | 9.0 | 4.0 | 0.9 | 0.30 | 0.15 | 2.0 |

For comparison, a standard type carbon steel tube which has been hard chromated was selected. The results from these comparative fatigue tests are given in Table 2 below.

TABLE 2

| Steel alloy | Fatigue strength |
|---|---|
| 1RK91 | 300 MPa |
| Hard chromated C-steel | 195 MPa |

As clearly apparent from Table 2 the alloy of the invention, 1RK91, has a much higher fatigue strength than the steel presently used in shock absorbers. This is primarily a result of selecting a material with martensite and precipitated quasicrystalline particles appearing in the microstructure after its fabrication according to the invention. Other properties which are clearly representative in describing the level of the mechanical properties are hardness level and the E-modulus (Young's modulus) which is normally given in terms of GPa.

Table 3 below shows these values for the material 1RK91 selected according to the invention, as compared with the standard type C-steel tube as referred to in the previous tables.

TABLE 3

Mechanical properties

| Alloy | Hardness ($H_v$) | E (GPa) |
|---|---|---|
| 1RK91, aged | 565 | 201 |
| C-steel (surface area) | 518 | 218 |
| C-steel (central wall area) | 314 | |

As appears from Table 3 the hardness level for the inventive 1RK91 alloy is clearly higher than for the standard type carbon steel although the surface area of the later has been hard chromated. It is also of importance that the E-modulus value is almost at same level as it is for the carbon steel. This is a surprising result since normally the E-modulus value for stainless steel alloys never reach the level of that for carbon steel. Further measured values which are of importance to qualify the mechanical properties of a material is given in Table 4 below.

TABLE 4

| Alloy | Mechanical test results $R_p$ 0.05 (MPa) | $R_p$ 0.2 (MPa) | Rm (MPa) tensile strength | A % (elongation) |
|---|---|---|---|---|
| 1RK91 | 1830 | 1850 | 1870 | 6.7 |
| C-steel reference | 578 | 635 | 644 | 13.3 |

It clearly appears from Table 4 that the 1RK91 alloy of the present invention will outperform the standard carbon steel in terms of its mechanical properties.

The tendency of thermal expansion is another important property to be taken into account when. it comes to vehicle components such as shock absorbers. In Table 5 below the thermal expansion values are given for the 1RK91 material in comparison with both standard carbon steel type 4L7 and standard type 18/10-stainless steel alloys.

TABLE 5

| Temperature ° C. | Thermal expansion values (μm/(m × ° C.) 1RK91 | C-steel 4L7 | Alloy 18/10 |
|---|---|---|---|
| 30–100 | 11.48 | 12.3 | 16.7 |
| 30–200 | 11.87 | 12.8 | 17.3 |
| 30–300 | 12.19 | 13.5 | 17.8 |
| 30–400 | 12.45 | 14.0 | 18.1 |

The thermal expansion value is of importance in the fabrication and use of automotive components wherein there is a demand that any tolerance deviations shall be kept within very restricted. limits. The important conclusion that can be drawn from this table is that it was found possible with the steel according to the present invention to achieve thermal expansion values fully comparable with those achieved with conventional carbon steel, and at the same time outperforms the conventional carbon steel in terms of mechanical properties.

Corrosion properties are also important for a material used in vehicle components. At the same time, the material should be easily formable so as to enable its fabrication in the form of wire, tube, bar and strip for its further use in these kind of applications.

In order to investigate the corrosion properties of the material according to this invention such material has been subjected to tests in comparison with other existing alternative stainless materials such as Tp 316 and Tp 304.

While the present invention has been described by reference to the above-mentioned embodiments, certain modifications and variations will be evident to those of ordinary skill in the art. Therefore the present invention is to limited only by the scope and spirit of the appended claims.

What is claimed is:

1. An automotive component having corrosion resistance, high strength and toughness, the automotive component formed as a tubular member having a composition comprising at least 0.5% by weight chromium, at least 0.5% by weight molybdenum, and the sum of Cr, Ni and Fe exceeds 50% by weight; the automotive component having a microstructure comprising at least 70% martensite with quasicrystalline particles of intermetallic compounds dispersed in the martensite.

2. The automotive component of claim 1, wherein the composition of the component comprises, in weight %:

| | |
|---|---|
| Carbon | max 0.1; |
| Nitrogen | max 0.1; |
| Copper | 0.5–4; |
| Chromium | 10–14; |
| Molybdenum | 0.5–6; |
| Nickel | 7–11; |
| Cobalt | 0–9; |
| Tantalum | max 0.1; |
| Niobium | max 0.1; |
| Vanadium | max 0.1; |
| Tungsten | max 0.1; |
| Aluminum | 0.05–0.6; |
| Titanium | 0.4–1.4; |
| Silicon | max 0.7; |
| Manganese | ≦1.0; and |
| Iron | remainder, except usual impurities. |

3. The automotive component of claim 1, wherein the automotive component comprises a shock absorber tube.

4. A method of manufacturing comprising:

smelting an alloy having a composition comprising at least 0.5% by weight chromium, at least 0.5% by weight molybdenum, and the sum of Cr, Ni and Fe exceeds 50% by weight;

casting the alloy;

subjecting the casting to hot extrusion and then to a plurality of cold rolling steps;

thereafter cold deforming the alloy to obtain of at least 50% martensite throughout its microstructure; and subjecting the alloy to an ageing treatment at 425–525° C. that is sufficient to obtain precipitation of quasi-crystalline particles in the martensitic microstrucure, wherein the total amount of deformation occurs without an intermediate annealing step between each and every deformation step.

5. The method of claim 4, wherein the alloy has a composition comprising:

| | |
|---|---|
| Carbon | max 0.1; |
| Nitrogen | max 0.1; |
| Copper | 0.5–4; |
| Chromium | 10–14; |
| Molybdenum | 0.5–6; |
| Nickel | 7–11; |
| Cobalt | 0–9; |
| Tantalum | max 0.1; |
| Niobium | max 0.1; |
| Vanadium | max 0.1; |
| Tungsten | max 0.1; |
| Aluminum | 0.05–0.6; |
| Titanium | 0.4–1.4; |
| Silicon | max 0.7; |
| Manganese | ≦1.0; and |
| Iron | remainder, except usual impurities. |

6. The method of claim 4, further comprising cold deforming the alloy to produce a microstructure having at least 70% martensite.

7. The method of claim 4, further comprising ageing the alloy at a temperature of 475° C. for a time period of 4 hours.

8. The automotive component of claim 1, wherein the casting subsequent to the ageing step has a fatigue strength of greater than or equal to 300 Mpa.

9. The automotive component of claim 1, wherein the casting subsequent to the ageing step has a hardness of at least 500 $H_v$.

10. The automotive component of claim 1, wherein the composition comprises a maximum of 0.7% by weight of silicon.

11. The method of claim 4, wherein the composition comprises a maximum of 0.7% by weight of silicon.

* * * * *